United States Patent [19]

Chahin

[11] Patent Number: 4,869,151

[45] Date of Patent: Sep. 26, 1989

[54] NOISE AND RECOIL SUPPRESSOR APPARATUS FOR HIGH POWERED RIFLES

[76] Inventor: Eduardo A. Chahin, 2550 Lirocchi Dr., Baton Rouge, La. 70816

[21] Appl. No.: 87,672

[22] Filed: Aug. 19, 1987

[51] Int. Cl.[4] ..... F41C 21/18

[52] U.S. Cl. ..... 89/14.3; 89/14.4; 181/223

[58] Field of Search ..... 89/14.3, 14.4; 181/223

[56] References Cited

U.S. PATENT DOCUMENTS

| | | | |
|---|---|---|---|
| 1,259,251 | 3/1918 | Love | 89/14.3 |
| 2,883,911 | 4/1959 | Musgrave | 89/14.3 |

FOREIGN PATENT DOCUMENTS

| | | | |
|---|---|---|---|
| 588100 | 12/1959 | Canada | 89/14.3 |
| 67 | 1/1855 | United Kingdom | 89/14.3 |

*Primary Examiner*—Stephen C. Bentley

*Attorney, Agent, or Firm*—Pravel, Gambrell, Hewitt, Kimball & Krieger

[57] ABSTRACT

A noise and recoil suppressor apparatus for high powered rifles includes a tubular body with an inner central cylindrical bore and an outer cylindrical surface. A butt end portion of the tubular body is adapted for attachment to the muzzle end portion of a high powered rifle and the body provides an opposite tip portion. An annular rib extends outwardly from the outer cylindrical surface and is positioned adjacent the butt end portion of the tubular body. A plurality of space apart latterally extending cylindrical openings extends between the bore and the outer surface of the tubular body, the first plurality of openings being spaced along the tubular body beginning at the tip portion and terminating at the annular rib. A second plurality of openings extends at an acute angle with respect to the bore axis between the bore and the outer cylindrical surface adjacent the annular rib. The second plurality of openings are positioned generally between the annular rib and the first plurality of openings. Each of the second plurality of openings provides a gas travel path from the inner bore to the outer surface thereof at an angle and with an angular velocity component which forces sound waves away from the shooter.

12 Claims, 1 Drawing Sheet

NOISE AND RECOIL SUPPRESSOR APPARATUS FOR HIGH POWERED RIFLES

BACKGROUND OF THE INVENTION

1. Field of the Invention:

The present invention relates to muzzle brakes, noise suppressors and recoil suppressors particularly those used with high powered rifles. Even more particularly, the present invention relates to an improved noise and recoil suppressor apparatus for high powered rifles wherein angled and radially spaced bores positioned upstream of a plurality of lateral bores in combination with an upstream annular rib shields the shooter from sound waves exiting from downstream transverse exhaust ports.

2. General Background:

A commonly used weapon for big game hunting and marksmanship is a high powered rifle. High powered rifles are typically available in a bolt action, pump, or semi-automatic configuration. The caliber that is typically referred to as high powered include .243 caliber and above, such as, for example, .308 caliber, 30.06 caliber, .243 caliber, .270 caliber, and 7 mm magnum caliber, and a host of even more powerful rifles that are referred to in the art as magnum calibers. Weapons of this type are common and commercially available being manufactured by Winchester, Colt, Weatherby, Saur, Sako, to name a few.

One of the problems with high powered rifles is the recoil generated when the shooter fires the weapon. A common cause of poor marksmanship is the grimmace or flinch that occurs with many shooters at the time the trigger is pulled because the shooter anticipates the intense recoil and noise which he or she will experience when the weapon is fired.

One of the solutions to high recoil is to attach a tubular recoil suppressor to the end of the barrel in order to vent escaping gases in a lateral direction when the weapon is fired, thus reducing somewhat the recoil which is felt by the shooter. Unfortunately, the venting of gases in a transverse or lateral direction from the bore of the rifle when the rifle is fired creates coincidentally a discharging of sound waves in a lateral direction and thus a large increase in noise level to the ears of the shooter. Thus, noise has been a problem especially with marksmanship wherein a large number of rounds are being fired over a long period of time since high noise levels can be very damaging to the shooter's ears.

Examples of patents which show recoil suppressors include, for example, the Dahl U.S. Pat. No. 3,164,060, entitled "Gun Recoil, Flash And Sound Reducer Assembly"; the Blair U.S. Pat. No. 4,583,445, entitled "Flash Reducing Muzzle Brake"; the Ashbrook U.S. Pat. No. 3,115,060, entitled "Gas Inertia Controller"; the Mutter U.S. Pat. No. 2,916,970, entitled "Anti-Recoil Gun Barrels"; the Johnson U.S. Pat. No. 4,643,073, entitled "Muzzle Stabilization Arrangement For Firearms"; and the Chinn U.S. Pat. No. 3,141,376, entitled "Flame-Out Eliminator".

Other devices are known which relate to silencing of noise generated by the firing of a weapon. Such noise reducers which are affixed to the muzzle end portion of a rifle are commonly referred to as "silencers". Examples of patents that show silencers include: U.S. Pat. No. 1,127,250, issued to H. Humm, entitled "Silencer"; U.S. Pat. No. 1,773,443, issued to Wilman, entitled "Manufacture Of Silencers Or Exhaust Tanks For Machine Guns And Other Automatic Arms"; U.S. Pat. No. 4,588,043, issued to Finn, entitled "Sound Suppressor For A Firearm"; U.S. Pat. No. 3,677,132, issued to Plenge and entitled "Waterproof Sound, Flash And Recoil Suppressor For Firearms"; U.S. Pat. No. 2,503,491, issued to R. Janz, entitled "Gun Silencer Including Side Branch Chamber"; and U.S. Pat. No. 3,748,956, issued to Hubner, entitled "Silencer For Fire Arms".

One of the problems of prior art suppressors and muzzle brakes is the failure to provide a simple, straightforward yet workable apparatus which controls both the recoil and the sound level experienced by the shooter without providing an overly complicated mechanism that is prone to malfunction because of powder build-up or breakage of moving parts. Many of the above-referenced patents include multiple baffles, springs, and/or moving parts which create problems when a gun or rifle is used in a hostile environment, such as during rain, or in very cold conditions as is commonly the case in hunting.

SUMMARY OF THE PRESENT INVENTION

The present invention solves these prior art problems and shortcomings by providing an apparatus having an annular ridge which shields the shooter from noise/-recoil when the weapon is fired. Further, the present invention provides a plurality of exhaust ports extending radially around the apparatus adjacent the annular ridge to blow gases and noise away from the shooter thus reducing sound waves which would otherwise possibly damage the shooter's ears. With the present invention, the porting areas (the areas where the ports start) are maintained at very close dimensions over the bore diameter making the present invention very effective and efficient. At the same time, the bullet exiting the rifle does not touch the inner walls of the apparatus in order to preserve accuracy. Thus, the present invention provides an apparatus for reducing recoil and noise wherein close dimensional tolerances are maintained over the bore diameter which does not allow any gas to surpass the bullet or to depart from the barrel in a forwardly direction, thus forcing gases through radial ports eliminating "gas recoil" and making the force of the gases support the weapon from the secondary force of recoil which is internal recoil of the weight of the bullet, plus the weight of the powder traveling forward at tremendous speeds. Typically a bullet will travel over 3,000 ft. per second and powder and gases will travel at over 15,000 ft. per second. By keeping the tolerances close, and not allowing gases to move forward of the bullet, gas disturbance does not affect accuracy of the weapon.

The present invention provides a noise and recoil suppressor apparatus for high powered rifles that includes a tubular body with a cylindrical outer surface and having a central cylindrical tubular body bore with a central bore axis, and a butt end portion adapted for attachment to the muzzle of the high powered rifle. An annular rib extends outwardly from the outer cylindrical surface of the tubular body and is positioned adjacent the butt end portion thereof. A plurality of spaced apart, laterally extending ports or openings extends between the bore and the outer cylindrical surface, the first plurality of openings being spaced along the tubular body between the end portion and the annular rib.

A second plurality of openings each second opening extending at an acute angle with respect to the bore axis between the bore and the outer cylindrical surface adjacent the annular rib is provided, the second plurality of openings being positioned between the annular rib and the first plurality of openings. Each of the second plurality of openings extends forwardly to provide gas travel paths between the bore and the exterior surface through which gas can travel during a firing of the high powered rifle to the exterior of the tubular body with a forward velocity component so that gas exiting the second plurality of openings in combination with the annular rib shields sound waves exiting the first plurality of openings from the shooter. In the preferred embodiment, the first plurality of openings are of a larger diameter than the second plurality of openings. In the preferred embodiment, the second plurality of openings are equi-radially spaced.

In the preferred embodiment, the second plurality of openings each define transverse and angled bores that intersect the tubular body bore axis.

In the preferred embodiment, the tubular body bore axis coincides with the rifle bore axis, but the tubular body bore is of a slightly larger diameter than the rifle bore axis.

In the preferred embodiment, the first plurality of openings are transverse, cylindrical openings.

In the preferred embodiment, the first plurality of openings comprise multiple cylindrical openings, each having a central axis which intersects the tubular bore axis at substantially right angles.

The second plurality of openings in the preferred embodiment have bores which intersect the main body bore at a common angle and at a common position.

In the preferred embodiment, the common angle is between twenty and thirty degrees (20° and 30°).

In the preferred embodiment, the annular rib is defined by a frustro-conical outer surface of the tubular body beginning at the butt end portion thereof and terminating at the largest diameter section of the annular rib.

In the preferred embodiment, the annular rib comprises two jointed annular frustro-conical surfaces each having different cross-sectional configurations but identical maximum diameters at their joint.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
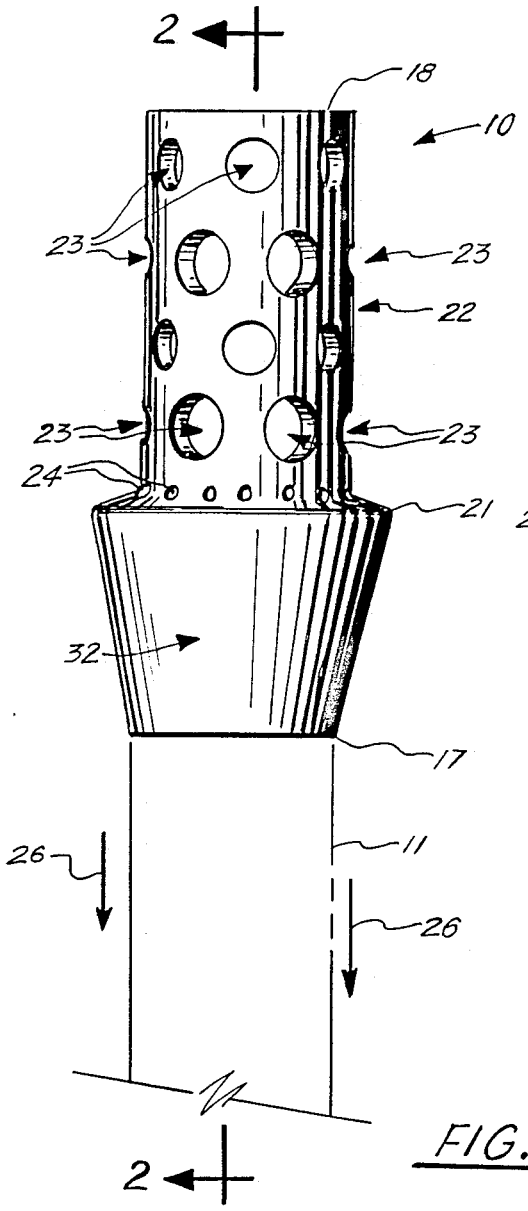
FIG. 1 is a top view of the preferred embodiment of the apparatus of the present invention and illustrating the rifle barrel in phantom lines.
Figure 2:
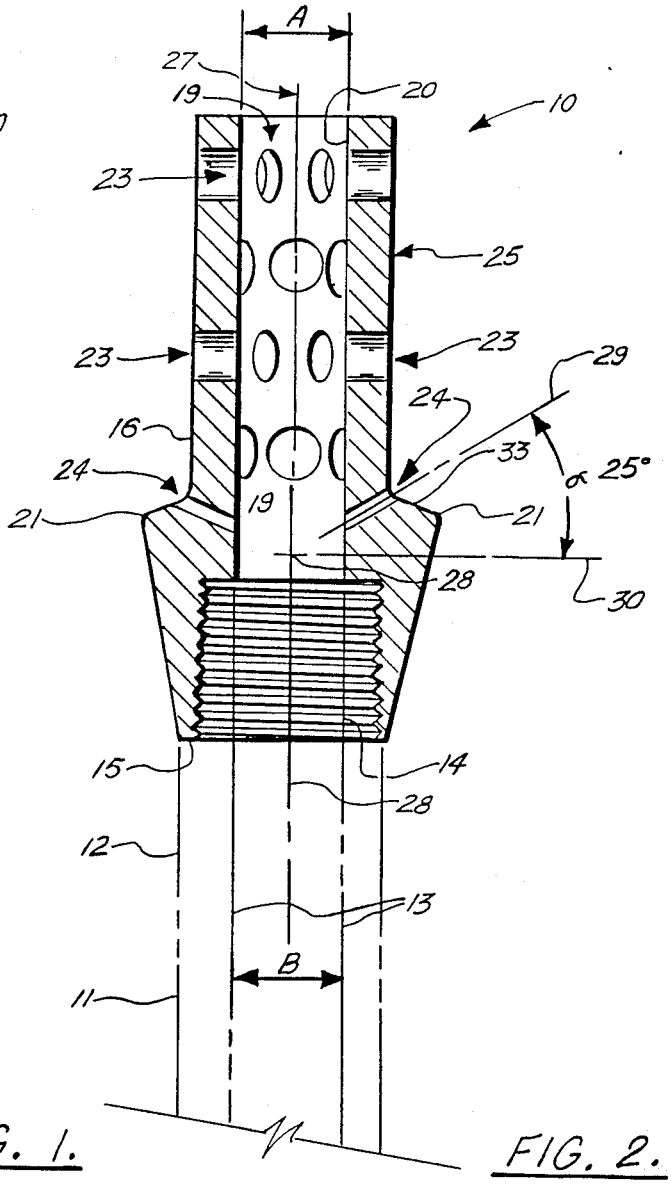
FIG. 2 is a top sectional view of the preferred embodiment of the apparatus of the present invention illustrating the rifle barrel in phantom lines.
Figure 3:
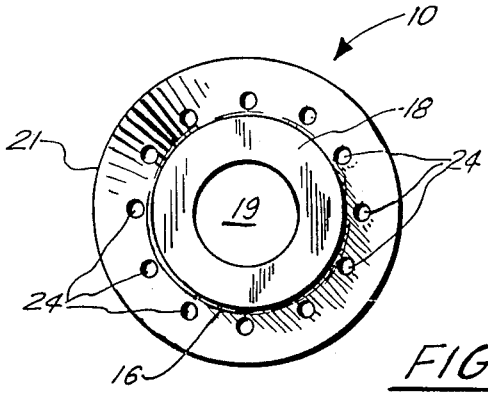
FIG. 3 is a front end view of the preferred embodiment of the apparatus of the present invention looking from the muzzle tip toward the end butt portion thereof.

In FIGS. 1-3, the preferred embodiment of the apparatus of the present invention is designated generally by the numeral 10. The noise and recoil suppressor apparatus 10 for high powered rifles attaches to the muzzle end portion 11 of a high powered rifle, the barrel being shown in FIGS. 1 and 2 in phantom lines. In FIG. 2, the bore diameter of high powered rifle 11 is shown by the dimension line B and and the outer surface 12 of rifle barrel 11 is designated as well as the inner walls 13 thereof which define the rifle 11 bore. The muzzle end portion 14 of rifle 11 is provided with a plurality of male threads which are receptive of female threads 15 provided on tubular body 16. Noise and and recoil suppressor apparatus 10 is comprised of a substantially cylindrical elongated tubular body 16 having a butt end portion 17 and a forward muzzle end tip portion 18. The tubular body 18 provides a central cylindrical bore 19 of substantially uniform cylindrical configuration having a uniform cylindrical diameter, for example, illustrated by the dimension line A in FIG. 2. It should be understood that dimension line A is slightly larger than dimension line B thus, the cylindrical bore 19 of tubular body 16 is of slightly larger internal diameter than the internal diameter B of the rifle bore defined by inner wall 13.

In the preferred embodiment, bore dimension A is approximately 0.008 inches to 0.014 inches larger than bore inner diameter B of rifle 11. In this manner, a bullet exiting rifle barrel 11 will not touch the inner wall 20 of cylindrical body 16 which defines bore 19.

An annular rib 21 extends outwardly from the outer cylindrical surface 22 of cylindrical body 16 and is positioned adjacent the butt 17 end portion thereof, as best seen in FIGS. 1 and 2. The tubular body provides a first plurality of spaced apart and laterally extending exhaust port openings which function as exhaust ports for expanding gases, as well as for escape of sound waves and noise. The first plurality of exhaust port openings 23 are spaced along the tubular body 16 between the end portion 18 and terminating at annular rib 21, as shown in FIGS. 1 and 2.

A second plurality of openings 24 extends between bore 19 of tubular body 16 and the outer cylindrical surface 25 of tubular body 16 and at a position adjacent annular rib 21. Thus, the second plurality of openings 24 is positioned generally between annular rib 21 and the first plurality of openings 23.

Each of the second plurality of openings 24 extend forwardly to provide gas travel paths between the bore 19 and the exterior surface 25 of tubular body 16 through which gas can travel to the exterior surface 25 of the tubular body 16 during a firing of the high powered rifle 11 and with a forward velocity component so that gas exiting the second plurality of openings 24 in combination with the annular rib 21 can shield sound waves exiting the first plurality of openings 23 from the shooter. It should be understood by an inspection of FIGS. 1 and 2 that only the muzzle end portion of high powered rifle 11 is shown. One skilled in the art will notice that the shooter will be positioned at the opposite end portion of the rifle so that sound waves exiting ports 23 are prevented from traveling in a path along the rifle barrel 11, as indicated by the Arrows 26 in FIG. 1.

In the preferred embodiment, the first plurality of openings 23 are of a larger diameter than the second plurality of openings 24. Typically, the first openings 23 are exhaust ports which allow gases to exit the bore 19 when the rifle 11 is fired. The second plurality of openings 21 are preferably equi-radially spaced, as shown in FIG. 3. The second plurality of openings 24 each define transverse and angled bores that intersect the tubular body bore axis 27. The tubular body bore axis 27 preferably coincides with the rifle bore axis 28. An inspection of FIG. 2 will show that the second plurality of openings 24 comprise multiple cylindrical openings each having a central axis which intersects the tubular body bore 19 at axis 27 and at the same position, which is shown in FIG. 2 as 28. The angle Alpha shows the acute angle formed between the axis 29 of each angled bore formed by openings 24 and the line 30 which is at right angles to bore axis 27. This illustrates that the transverse and angled bores 24 are forwardly facing and at an acute angle with respect to the tube body 16 bore axis 27.

In the preferred embodiment, the angle formed between the axis 29 of openings 24 and the line 30 perpendicular to bore axis 29 would preferably be an angle between twenty and thirty degrees (20° and 30° ). Notice from an inspection of FIGS. 1 and 2 that annular rib 21 is defined by a frustro-conical outer surface 32 of the tubular body 16 beginning at butt end 17 portion of the tubular body 16 and terminating at the largest diameter section of annular rib 21. Annular rib 21 is thus formed by two annular frustro-conical surfaces 32, 33 having different cross-sectional configurations but identical maximum diameters at their joint, as shown in FIGS. 1 and 2.

The present invention could be manufactured of any suitable structural material, preferably the same steel of which the barrel is manufactured.

The foregoing description of the invention is illustrative and explanatory thereof, and various changes in the size, shape and materials, as well as in the details of the illustrated construction may be made without departing from the spirit of the invention.

What is claimed as invention is:

1. A noise and recoil suppressor apparatus for a rifled bore-type high powered rifle that is held by a shooter during firing so that the shooter is subjected to the recoil and noise generated by the rifle when fired, comprising:

a. a tubular body with a generally cylindrical outer surface and having a central cylindrical bore with a central bore axis and of a diameter greater than the rifled bore, the body including a butt end portion having means for attachment to the muzzle end of the high powered rifle, and an opposite forward tip end portion;

b. an annular rib extending radially outwardly from the outer cylindrical surface terminating at a peripheral edge, and positioned adjacent the butt end portion of the tubular body, the peripheral edge defining an outermost maximum diameter of the rib, the rib including a forwardly facing annular surface extending between the peripheral edge and the cylindrical outer surface at an intersection therewith;

c. a first plurality of spaced apart laterally extending recoil reducing port openings, each opening extending between the tubular body bore and the outer cylindrical surface, the first plurality of openings being spaced along the tubular body forwardly of the annular rib;

d. a second plurality of openings, each extending at an acute angle with respect to the tubular body bore axis and communicating between the bore and the outer cylindrical surface adjacent the intersection of the forwardly facing annular surface of the annular rib and the outer cylindrical surface, the second plurality of openings being positioned between the annular rib and the first plurality of openings; and e. each of the second plurality of openings extending forwardly to provide gas travel paths between the bore and the exterior surface through which gas can travel to the exterior surface of the tubular body during a firing of the high powered rifle with a forward velocity component so that gas exiting the second plurality of openings in combination with the annular rib can shield sound waves exiting the first plurality of openings from the shooter, lowering noise levels experienced by the shooter.

2. The apparatus of claim 1 wherein the first plurality of openings are of a larger diameter than the second plurality of openings.

3. The apparatus of claim 1 wherein the second plurality of openings are equi-radially spaced.

4. The apparatus of claim 1 wherein the second plurality of openings each define radially extending angled bores that intersect the tubular body axis.

5. The apparatus of claim 1 wherein the tubular body bore axis coincides with the rifle bore axis but the body bore axis is of a slightly larger diameter than the rifle bore axis.

6. The apparatus of claim 1 wherein the first plurality of openings are transverse cylindrical openings.

7. The apparatus of claim 6 wherein the first plurality of openings comprise multiple cylindrical openings each having a central axis which intersects the tubular body bore axis at substantially right angles.

8. The apparatus of claim 4 wherein the second plurality of openings have bores which intersect the main body bore at a common angle and at a common position.

9. The apparatus of claim 8 wherein the common angle is an acute angle with a value of at least twenty degrees (20°).

10. The apparatus of claim 1 wherein the annular rib is defined by a frusto-conical outer surface of the tubular body beginning at the butt end portion of the tubular body and terminating at the largest diameter section of the annular rib.

11. The apparatus of claim 10 wherein the annular rib comprises two joined annular, frusto-conical surfaces having different cross-sectional configurations but identical maximum diameters at their joint.

12. The apparatus of claim 10 wherein the central cylindrical bore has an internal diameter no more than 0.015 inches greater than the rifle bore internal diameter.

* * * * *